US006655052B2

(12) United States Patent
Bruce

(10) Patent No.: US 6,655,052 B2
(45) Date of Patent: Dec. 2, 2003

(54) STRAP BRACKET

(75) Inventor: Geoffrey S. Bruce, Essex Junction, VT (US)

(73) Assignee: Hotronic USA, Inc., Williston, VT (US)

( * ) Notice: Subject to any disclaimer, the term of this patent is extended or adjusted under 35 U.S.C. 154(b) by 75 days.

(21) Appl. No.: 09/942,841

(22) Filed: Aug. 31, 2001

(65) Prior Publication Data

US 2003/0041480 A1 Mar. 6, 2003

(51) Int. Cl.[7] ..... G01C 21/00

(52) U.S. Cl. ..... 36/136; 36/132; 224/673; 224/930

(58) Field of Search ..... 36/132, 136, 117.1, 36/2.6; 206/701, 703–705, 722, 460, 813; 224/219, 222, 661, 673, 678, 902, 929, 930; 248/674

(56) References Cited

U.S. PATENT DOCUMENTS 2,625,192 A * 1/1953 Kinskie ..... 224/930
5,014,892 A * 5/1991 Copeland ..... 224/673
5,054,672 A * 10/1991 Weissman ..... 224/678
5,097,997 A * 3/1992 Kipnis et al. ..... 224/930
5,370,622 A * 12/1994 Livingston et al. ..... 224/673
6,357,147 B1 * 3/2002 Darley et al. ..... 36/136

OTHER PUBLICATIONS

Hotronic USA, Inc., *Hotronic FootWarmer Power Plus*, "Attaching Battery Pack", 2000/2001.
Hotronic Electronic Heating System, FootWarmer, 1994–1995 Sales and Technical Manual; 2 pages.
Hotronic Electronic Heating System, FootWarmer, Putting An End To Cold Feet! Brochure; 1998; 3 pages.

* cited by examiner

*Primary Examiner*—Luan K. Bui
(74) *Attorney, Agent, or Firm*—Roylance, Abrams, Berdo & Goodman, LLP

(57) ABSTRACT

A bracket that supports an electrical component, such as a battery pack, comprising a main plate that includes opposing first and second surfaces, a mounting portion, and a retaining portion. A mounting extends from the mounting portion of the main plate and supports the electrical component. A first support leg extends from the main plate with a first slot being defined between the retaining portion and the first support leg.

25 Claims, 2 Drawing Sheets

STRAP BRACKET

FIELD OF THE INVENTION

The invention relates to a strap bracket useful for securing a removable electrical component to footwear, such as a boot. The strap bracket is particularly useful for securing an external battery pack and electronics of an electrically heated insert sole to the outside of a ski boot.

BACKGROUND OF THE INVENTION

Snow skiing and similar cold weather outdoor sports can be enjoyed for as long as the feet and toes stay warm. Battery powered, adjustably heated insert soles or liners are often used to supply heat for the feet and toes. Such units extend the enjoyable duration of exposure to cold environments and have proven to be quite durable.

The external battery pack is typically mounted on the user's boot in an area that is out of the way. Typically, users will mount the battery pack on the top front, top side, or top back of the boot with a bent wire clip secured to one face of the generally rectangular battery pack. Unfortunately, the back of the boot is often subject to bumps and scrapes from chair lifts, street curbs and stair treads which cause damage to the battery pack. As well, mounting the battery pack on the front or side of the boot often obstructs the operation of any top closure mechanism or system, such as a buckle or power strap. It would be helpful to have a system for securing the battery pack to the outside of a boot in a manner that does not obstruct the operation of any top closure mechanism or system, such as a buckle or power strap, on the boot and in a location that does not often hit curbs, chair lifts, or the like. Additionally, securing the battery pack to the user's leg or arm would also substantially prevent damage to the pack.

SUMMARY OF THE INVENTION

Accordingly, an object of the present invention is to provide a bracket that supports an electrical component, such as a battery pack, and that easily attaches to a strap.

Another object of the present invention is to provide a bracket that can be positioned as desired along a footwear strap, particularly on the outer lateral side of the footwear, thereby avoiding damage to the bracket and an electrical component supported by the bracket and avoiding obstruction of any top closure mechanism or system.

Yet another object of the present invention is to provide a bracket that supports an electrical component and attaches to a strap worn on a user's leg or arm.

Still another object of the present invention is to provide a bracket that supports an electrical component that is simple in design and can be formed as a unitary one-piece member, thereby reducing manufacturing costs.

The foregoing objects are basically attained by a bracket comprising a main plate that includes a mounting portion and a retaining portion; a mounting extends from the mounting portion of the plate with the mounting supporting an electrical component; and a strap is releasably coupled to the retaining portion of the main plate.

The foregoing objects are also attained by a bracket, comprising a main plate with opposing first and second surfaces, a mounting portion, and a retaining portion. A mounting extends from the mounting portion of the main plate, and supports an electrical component. A first support leg extends from the main plate with a first slot defined between the retaining portion and the first support leg.

The foregoing objects are also attained by a bracket assembly, comprising a bracket including a main plate that has opposing first and second surfaces, a mounting portion, and a retaining portion. The bracket also includes a mounting that extends from the mounting portion of the main plate, and the mounting supports the electrical component. A first support leg extends from the main plate with a first slot defined between the retaining portion and the first support leg. A strap is received in the first slot of the bracket.

The foregoing objects are also attained by footwear comprising a footwear upper that has an outer surface and a strap attached to the footwear upper. A bracket is coupled to the strap and includes a main plate that has opposing first and second surfaces, a mounting portion, and a retaining portion. The bracket also includes a mounting that extends from the mounting portion of the main plate. The mounting supports an electrical component. A first support leg extends from the main plate with a first slot being defined between the retaining portion and the first support leg.

Other objects, advantages and salient features of the invention will become apparent from the following detailed description, which, taken in conjunction with annexed drawings, discloses the preferred embodiments of the present invention.

BRIEF DESCRIPTION OF THE DRAWINGS

Referring to the drawings which form a part of this disclosure.

DETAILED DESCRIPTION OF THE INVENTION

Figure 3:
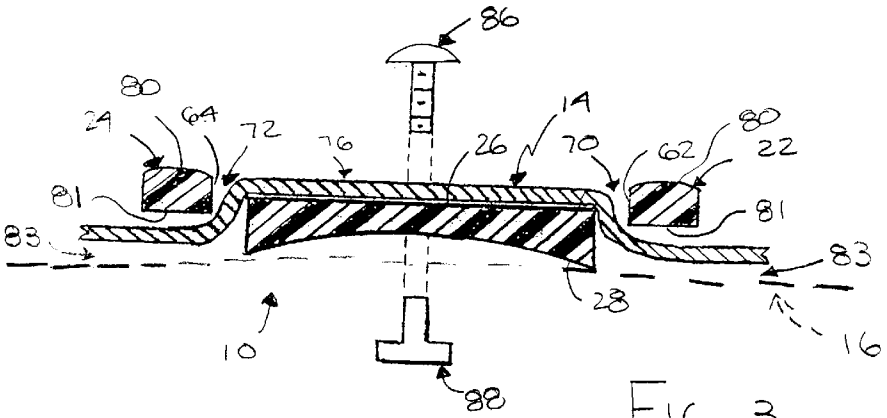
FIG. 3 is an enlarged, partially exploded, sectional view of the strap bracket illustrated in FIG. 1, showing the bracket and strap, and fasteners for coupling the bracket and strap.

Referring to FIGS. 1–6, a strap bracket 10 in accordance with the present invention supports an electrical component 12, such as a battery pack, on a strap 14 coupled to a piece of footwear 16, for example a ski boot. Strap bracket 10 provides a mechanism for attaching the battery pack 12 to the ski boot 16 in a location that both minimizes damage to the battery pack and avoids obstruction of the boot buckles. In particular, strap bracket 10 can be disposed on a lateral side of boot 16 along strap 14 to avoid obstacles, for example chair lifts and curbs, and near the top of the boot to avoid the boot's top buckle. Also, bracket 10 and strap 14 can be disposed on the user's leg or arm (not shown) rather than the user's boot 16.

As seen in FIGS. 1–4, strap bracket 10 generally includes a main plate 18, a mounting 20 for supporting electrical component 12, and first and second support legs 22 and 24 for engaging strap 14. Main plate 18 includes first and second opposing surface 26 and 28, and a longitudinal axis 30. First or front surface 26 is substantially planar and defines the plane of main plate 18 and bracket 10. Second or rear surface 28 is generally curved with respect to the longitudinal axis 30 of plate 18, as best seen in FIG. 3. The terms front and rear are used only to facilitate understanding of the invention, so that first and second surfaces 26 and 28 could be either a front or rear surface.

Main plate 18 has a general T-shape with first and second opposing sides 32 and 34, third and fourth opposing ends 36 and 38, a mounting portion 40 disposed at the head of the T-shaped plate 18 near end 36, and a retaining portion 42 disposed at the stem of the T-shaped plate 18 near end 38. Although a T-shape is preferable, main plate 18 can have a various polygonal or circular shapes, including a square, rectangular, or circle shape.

Figure 4:
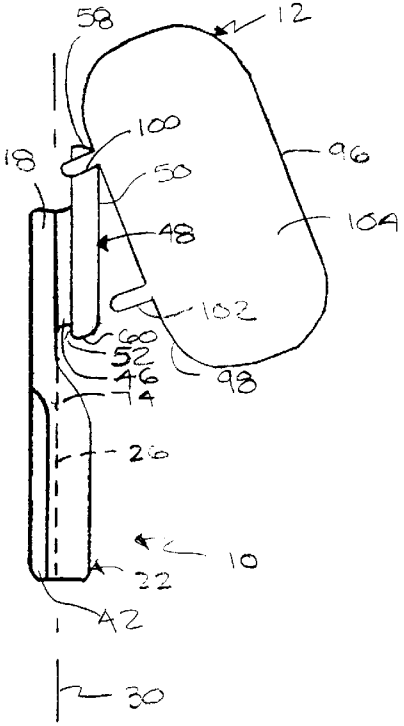
FIG. 4 is a side elevational view of the strap bracket illustrated in FIG. 1, showing the first step in attaching the battery pack to the bracket.

A mounting 44 extends from the front surface 26 of main plate mounting portion 40, preferably in a direction traverse to the main plate longitudinal axis 30, as seen in FIG. 4. Mounting 44 includes an extension member 46 and a mounting plate 48. Mounting plate 48 is substantially planar and defines a plane that is axially spaced from and parallel to the plane of main plate 18, as best seen in FIG. 4. The outer or front surface 50 of plate 48 abuts electrical component 12 when component 12 is supported thereon, and the rear surface 52 connects to extension member 46.

Mounting plate 48 is generally rectangular or square in shape and includes first and second sidewalls 54 and 56 and first and second endwalls 58 and 60. First and second sidewalls 54 and 56 are substantially parallel to the main plate first and second sides 32 and 34. Likewise, first and second endwalls 58 and 60 are substantially parallel to first and second ends 36 and 38 of main plate 18. However, mounting plate 48 can be any shape that will support electrical component 12, such as circular or trapezoidal. Also, instead of a mounting plate 48, mounting 44 can use any type of attachment, such as a hook member or an adhesive applied to extension 46. Alternatively, mounting plate 48 can be molded to create a surface for the battery pack 12 to slide over and attached thereto.

Figure 2:
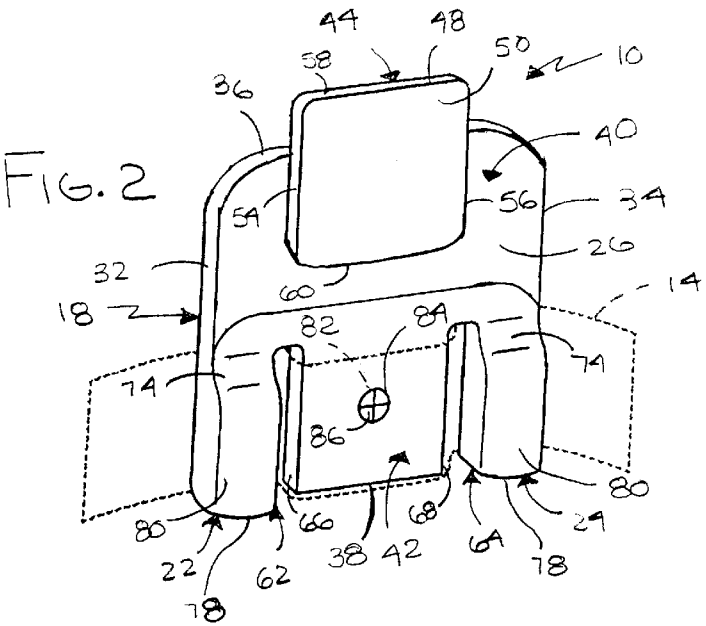
FIG. 2 is an enlarged perspective view of the strap bracket illustrated in FIG. 1, showing a strap in dashed lines.
Figure 1:
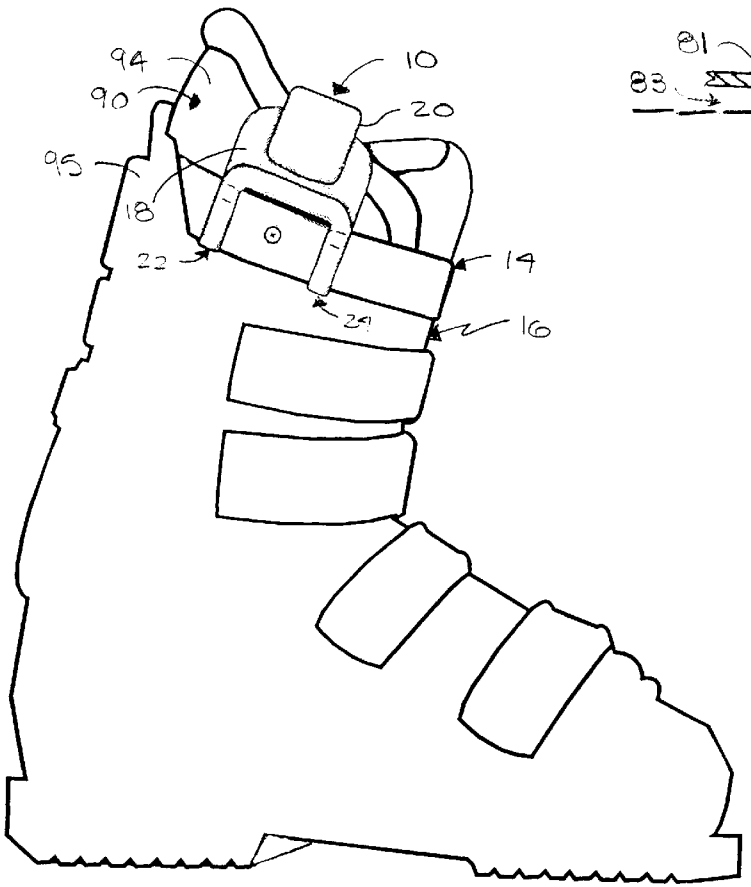
FIG. 1 is a side elevational view of a strap bracket in accordance with an embodiment of the present invention, showing the bracket attached to footwear, such as a ski boot, without an electrical component or battery pack supported thereon.

Extending from main plate 18 are first and second co-axial support legs 22 and 24. First and second slots 62 and 64 are defined between each of support legs 22 and 24, respectively, and first and second sidewalls 66 and 68, respectively, of the main plate retaining portion 42, so that slots 62 and 64 and support legs 22 and 24 are preferably generally parallel to the main plate longitudinal axis 30. However, support legs 22 and 24 are not required to be parallel. Slots 62 and 64 define first and second strap receiving areas 70 and 72 between first and second support legs 22 and 24, respectively, and retaining portion 42 of main plate 18, as seen in FIGS. 2 and 3. Also, each of first and second support legs 22 and 24 have an off-set section 74 that slopes and extends away from front surface 26 of main plate 18, as best seen in FIGS. 2–4. The off-set sections 74 of legs 22 and 24 define a third strap receiving area 76 between legs 22 and 24, as seen in FIG. 3. A fourth strap receiving area 83 is defined between surfaces 81 of legs 22 and 24 and footwear 16. Support legs 22 and 24 also each include generally planar first and second surfaces 80 and 81 extending from their off-set sections 74 that face generally the same direction as the front and rear surfaces 26 and 28 of bracket main plate 18.

Although, legs 22 and 24 are preferably off-set from main plate 18, they can be aligned or planar with main plate 18, or behind plate 18 by extending from the plate second or rear surface 28, as long as strap 14 can be received in slots 62 and 64. Also, the ends 78 of each support leg 22 and 24, respectively, are generally aligned with bracket retaining portion end 38. However, legs 22 and 24 can be shorter than or extend beyond retaining portion 42.

Bracket 10 is preferably formed as a one-piece unitary member. However, the components of bracket 10 can be formed separately and integrally attached. Also, bracket 10 is preferably formed of a plastic material but can be formed of other materials, such as metal. Rear surface 28 is not required to be curved and thus can be generally planar.

Strap 14 is received in first, second, and third receiving areas 70, 72, and 76 of bracket 10 for engaging bracket 10 and strap 14, as seen in FIG. 3. Strap 14 can be any flexible or semi-flexible member, such as a band, cord, rope, ribbon, lace or tape. Strap 14 includes a fastener hole 82 that corresponds to a fastener hole 84 of the bracket retaining portion 42, as seen in FIG. 2. Fastener hole 84 is preferably centrally disposed in retaining portion 42. First and second fasteners 86 and 88, are preferably a screw and T-nut, and extend through each fastener hole 82 and 84, thereby attaching strap 14 to bracket 10. Additional fasteners may be used. Also, any known attachment mechanism may be used instead of first and second fasteners 86 and 88, such as adhesive, hook and loop, snaps, or the like.

Strap 14 is typically wrapped and secured around the outer surface 94 of footwear upper 90, by inserting one end of strap 14 through a D-ring (not shown) at the opposite end folded back upon itself and preferable attached by a hook and loop attachment. A portion of strap 14 can also be attached either to the center back of an upper 90 of footwear 16, such as an inner boot of a ski boot or an outer shell 95 of footwear in any known manner.

Alternatively, strap 14 can be supported on the leg or arm of the user rather than on the boot. This would allow the user to support the battery pack 12 on either their leg or arm instead of on their boot. An end of strap 14 would have any known attachment, such as hook and loop, adhesive, snaps, or the like, allowing the user to wrap the strap 14 around their leg or arm, and secure the end of the strap 14 to the wrapped body of the strap, thereby securing the strap 14 to the user. Also, strap 14 can be tied around the leg or arm of the user.

Assembly

Referring to FIGS. 1–6, assembly of bracket 10 and strap 14 initially requires that strap 14 be placed in first, second, and third receiving areas 70, 72, and 76 of bracket 10, as best seen in FIG. 3. Strap 14 weaves through bracket 10 with strap 14 abutting or being slightly spaced from the front surface 26 of the bracket retaining portion 42, and with strap 14 abutting or being slightly spaced from the support legs 22 and 24 second surfaces 81. If strap 14 is located on a footwear upper 90, one end of strap 14 would have to be released before inserting strap 14 in bracket receiving areas 70, 72, and 76. If strap 14 is to be attached to the leg or arm of the user, strap 14 is assembled with bracket 14 prior to attaching strap 14 to the leg or arm.

Corresponding fastener holes 82 and 84 of strap 14 and bracket 10, respectively, are aligned, and first and second fasteners 86 and 88 are inserted therethrough, so that first fastener or screw 86 is received in second fastener or nut 88, thereby securing the two fasteners together and securing strap 14 to bracket 10. As mentioned above, strap 14 and bracket 10 can be attached by other attachment mechanisms such as adhesive, hook and loop, snaps, or the like. Also, although it is preferable to use one fastener 86 and one nut 88 extending through one strap fastener hole 82 and one bracket fastener hole 84, more than one fastener and more than one corresponding fastener holes in strap 14 and bracket 10 can be used.

Once bracket 10 and strap 14 are assembled, the strap bracket assembly is attached to the footwear upper 90 simply by wrapping the body of the strap around upper 90, with one end already attached to upper 90, and attaching its other end the strap body by a hook and loop attachment or the like. Strap 14 will be located between bracket support legs 22 and 24 and the outer surface of upper 90. Also, bracket retaining portion 42 is between the outer surface of upper 90 and strap 14. Bracket 10 can be placed anywhere along the lateral side of upper 90, as desired. For example, bracket 10 can be placed either more to the front or back of boot 16, or centrally located on the side of boot 16. Curved rear surface 28 of bracket 10 allows bracket 10 to generally conform to the outer side curvature of boot 16 resulting in a closer fit of bracket 10 to boot 16.

Alternatively, the strap bracket assembly can be attached to the leg or arm of the wearer, by wrapping strap 14 around the leg or arm, and attaching the strap end using a D-ring and using hook and loop or a like attachment. Strap 14 will be located between bracket support legs 22 and 24 and the user's leg or arm. Also, bracket retaining portion 42 will be between strap 14 and the user's leg or arm.

Figure 6:
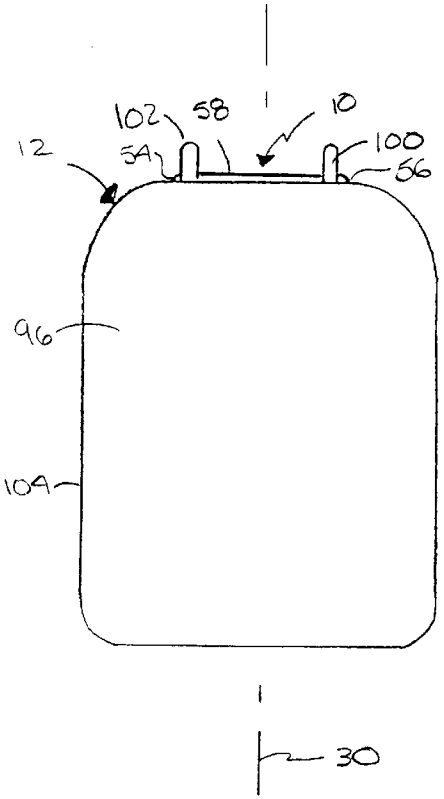
FIG. 6 is a front elevational view of the bracket illustrated in FIG. 1, showing the third step in attaching the battery pack to the bracket.
Figure 5:
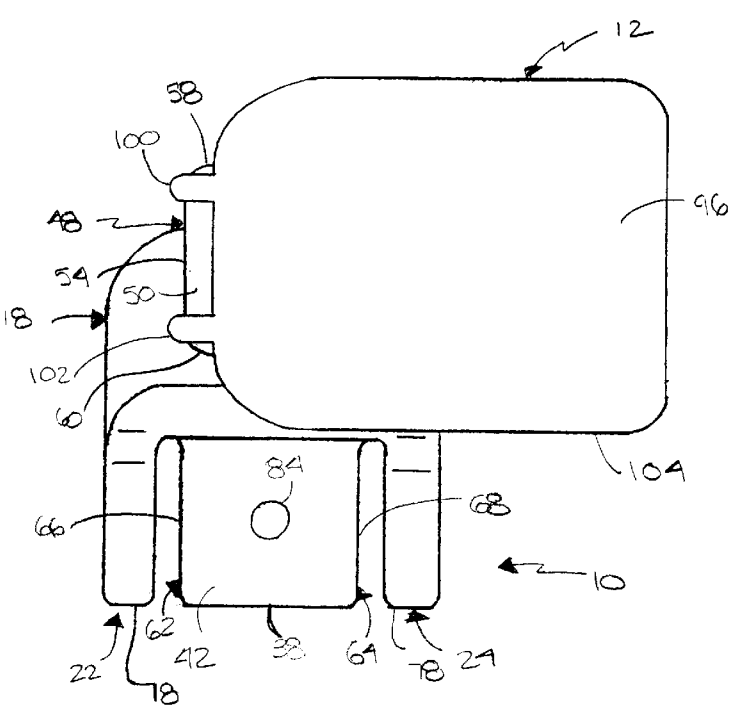
FIG. 5 is front elevational view of the bracket illustrated in FIG. 1, showing the second step in attaching the battery pack to the bracket.

Referring to FIGS. 4–6, once the strap bracket assembly is secured to either a footwear upper 90 or the leg or arm of the user, electrical component or battery pack 12 can be mounted to bracket 10. Battery pack 12 includes a first or outer surface 96 and an opposite or second surface 98 having a pair of spring wire loops 100 and 102, which are flexible and resilient, extending therefrom. To mount battery pack 12, it is first rotated to a horizontal position so that the body 104 of battery pack 12 is substantially perpendicular to the longitudinal axis 30 of bracket 10. By tilting battery pack 12 at an angle away from mounting 44 of bracket 10, first loop 100 of battery pack 12 can be placed over mounting plate 48 at its first endwall 58. Since loop 100 is flexible and resilient, it will flex to accommodate mounting plate 48 forming a substantially tight fit therebetween.

Once the first loop 100 of battery pack 12 is attached to mounting plate 48, second loop 102 can be snapped onto mounting plate 48 at its opposite endwall 60 by pushing battery pack 12 toward bracket 10 and opposite endwall 60. Specifically, the flexible and resilient nature of loop 102 allows loop 102 to cam over the mounting plate outer surface 50 and snap onto endwall 60. In this position, both loops 100 and 102 extend across mounting plate 48 from its first sidewall 54 to its second sidewall 56.

With both loops 100 and 102 attached to mounting plate 48 of bracket 10, battery pack 12 can be rotated from its horizontal position, as seen in FIG. 5, to a vertical position, as seen in FIG. 6, with battery pack body 104 being generally aligned with bracket longitudinal axis 30. The flexible and resilient nature of loops 100 and 102 allows battery pack 12 to be rotated by flexing to the shape of mounting plate 48 and extension 46, thereby maintaining a secure engagement therewith. In this position, loops 100 and 102 extend across mount plate 48 from its first endwall 58 to its second endwall 60. Removing battery pack 12 simply requires reversing the above steps. Although, this is the preferred method for attaching battery pack 12 to bracket 10, other methods of attachment can be used such as an adhesive attachment, hook and loop attachment, or the like.

Although, strap bracket 10 is preferably used with a ski boot to support a battery pack for powering a heatable inner sole or liner, bracket 10 can be employed with any type of footwear or shoe using a strap or lace of the shoe. Also, as mentioned above, the strap bracket 10 does not have to be used with a shoe at all, but can be wrapped on a person's leg or arm. Additionally, the strap bracket 10 is not limited to supporting a battery pack, but can support any component that can be attached to mounting plate 48 of bracket 10.

While a particular embodiment has been chosen to illustrate the invention, it will be understood by those skilled in the art that various changes and modifications can be made therein without departing from the scope of the invention as defined in the appended claims.

What is claimed is:

1. A bracket comprising:

a main plate including opposing first and second surfaces, a mounting portion, and a retaining portion, and said main plate defining a plane;

a mounting extending from said mounting portion of said main plate, said mounting extending from said first surface of said main plate in a direction substantially traverse to said plane, said mounting including a mounting plate defining a plane that is axially spaced from and substantially parallel to the plane of said main plate, and said mounting supporting an electrical component; and a first support leg extending from said main plate with a first slot being defined between said retaining portion and said first support leg.

2. A bracket according to claim 1, wherein said electrical component includes a loop extending therefrom; and said mounting plate is received in said loop, thereby supporting said electrical component.

3. A bracket according to claim 1, wherein a second support leg extends from said main plate with a second slot being defined between said retaining portion and said second support leg.

4. A bracket according to claim 1, wherein said first support leg extends away from said first surface so that said first support leg is substantially axially off-set from said plane of said main plate.

5. A bracket according to claim 1, wherein said main plate is coupled to a footwear.

6. A bracket according to claim 1, wherein said main plate is formed as a one-piece unitary member.

7. A bracket according to claim 1, wherein said main plate is formed of a plastic material.

8. A bracket comprising:

a main plate including opposing first and second surfaces, said first surface being substantially planar and said second surface being curved about a longitudinal axis of said main plate, a mounting portion, and a retaining portion;

a mounting extending from said mounting portion of said main plate, said mounting supporting an electrical component; and a first support leg extending from said main plate with a first slot being defined between said retaining portion and said first support leg.

9. A bracket according to claim 8, wherein a second support leg extends from said main plate with a second slot being defined between said retaining portion and said second support leg.

10. A bracket according to claim 8, wherein said first support leg extends away from said first surface so that said first support leg is substantially axially off-set from said plane of said main plate.

11. A bracket according to claim 8, wherein said main plate is coupled to footwear.

12. A bracket assembly comprising:

a bracket including, a main plate having opposing first and second surfaces, a mounting portion, and a retaining portion, a mounting extending from said mounting portion of said main plate, said mounting supporting an electrical component, a first support leg extending from said main plate with a first slot being defined between said retaining portion and said first support leg, and a second support leg extending from said main plate with a second slot being defined between said retaining portion and said second support leg; and a strap is being received in said first and second slots of said bracket.

13. A bracket assembly according to claim 12, wherein said first surface of said main plate defines a plane; and each of said first and second support legs, respectively, extends away from said first surface so that each of said first and second support legs, respectively, is substantially axially off-set from said plane of said main plate.

14. A bracket assembly according to claim 12, wherein said strap is releasably coupled footwear.

15. A bracket assembly according to claim 12, wherein said bracket is formed as a one-piece unitary member.

16. A bracket assembly according to claim 12, wherein said bracket is formed of a plastic material.

17. A bracket assembly according to claim 12, wherein said first surface of said main plate defines a plane; and said first and second support legs extend away from said first surface so that said first and second support legs are substantially axially off-set from said plane of said main plate.

18. A bracket assembly comprising:

a bracket including, a main plate having opposing first and second surfaces, a mounting portion, and a retaining portion, said retaining portion including a fastener holes, a mounting extending from said mounting portion of said main plate, said mounting supporting an electrical component, and a first support leg extending from said main plate with a first slot being defined between said retaining portion and said first support leg; and a strap being received in said first slot of said bracket, said strap including a fastener hole; and a fastener extending through each of said fastener holes of said retaining portion and said strap, thereby coupling said strap and said retaining portion.

19. A bracket assembly according to claim 18, wherein said strap is releasably coupled footwear.

20. A bracket assembly according to claim 18, wherein a second support leg extends from said main plate with a second slot being defined between said retaining portion and said second support leg for receiving said strap.

21. A bracket assembly according to claim 14, wherein said first surface of said main plate defines a plane; and said first support leg extends away from said first surface so that said first support leg is substantially axially off-set from said plane of said main plate.

22. A bracket comprising:

a bracket including, a main plate having opposing first and second surfaces, a mounting portion, and a retaining portion, a mounting extending from said mounting portion of said main plate, said mounting includes a mounting plate, and said mounting supporting an electrical component, said electrical component including a loop extending therefrom and said mounting plate being received in said loop, thereby supporting said electrical component, and a first support leg extending from said main plate with a first slot being defined between said retaining portion and said first support leg; and a strap received in said first slot of said bracket.

23. A bracket assembly according to claim 22, wherein said strap is releasably coupled footwear.

24. A bracket assembly according to claim 15, wherein a second support leg extends from said main plate with a second slot being defined between said retaining portion and said second support leg for receiving said strap.

25. A bracket assembly according to claim 15, wherein said first surface of said main plate defines a plane; and said first support leg extends away from said first surface so that said first support leg is substantially axially off-set from said plane of said main plate.

* * * * *